United States Patent [19]

Furtek

[11] Patent Number: 4,602,238

[45] Date of Patent: Jul. 22, 1986

[54] INFRARED PANEL EMITTER AND METHOD OF PRODUCING THE SAME

[75] Inventor: Edward J. Furtek, Salisbury, Mass.

[73] Assignee: Vitronics Corporation, Newmarket, N.H.

[21] Appl. No.: 572,362

[22] Filed: Jan. 20, 1984

[51] Int. Cl.[4] ..... H01C 1/026

[52] U.S. Cl. ..... 338/236; 29/611; 29/613; 219/345; 219/354; 338/255; 373/117; 373/127; 373/134

[58] Field of Search ..... 373/109, 117, 127, 134; 250/493.1, 495.1; 219/345, 354; 427/55; 118/641, 642; 338/250, 236, 253, 237, 254, 255, 316; 29/611, 613

[56] References Cited

U.S. PATENT DOCUMENTS

| | | | |
|---|---|---|---|
| 1,841,537 | 1/1932 | Kelleher | 338/237 |
| 2,939,807 | 6/1960 | Needham | 219/345 |
| 3,060,300 | 10/1962 | Horner | 219/345 |
| 3,214,565 | 10/1965 | Haser et al. | 219/345 |
| 3,564,207 | 2/1971 | Joeckel | 219/354 |
| 3,694,627 | 9/1972 | Blatchford et al. | 219/345 |
| 3,697,728 | 10/1972 | Stirzenbecher | 219/345 |
| 3,805,024 | 4/1974 | Joecket et al. | 219/354 |
| 3,809,859 | 5/1974 | Wells | 338/254 |
| 4,017,967 | 4/1977 | Wells et al. | 219/345 |
| 4,247,979 | 2/1981 | Eck | 219/345 |

*Primary Examiner*—John H. Newsome

*Attorney, Agent, or Firm*—Wolf, Greenfield & Sacks

[57] ABSTRACT

A nonfocused infrared panel emitter and method of making the same. The panel emitter includes a primary emitter positioned between an insulating layer and a secondary emitter. Preferably, the panel emitter comprises a metal foil primary emitter, woven alumina cloth secondary emitter, and alumina silica board insulating layer bonded together by means of an alumina silica binder. In the method of making the panel emitter, a mesh sheet is preferably positioned adjacent the foil and the sheet is vaporized by heating prior to bonding to create a void adjacent the foil to allow thermal expansion and contraction of the foil.

24 Claims, 4 Drawing Figures

INFRARED PANEL EMITTER AND METHOD OF PRODUCING THE SAME

FIELD OF THE INVENTION

This invention relates to a nonfocused infrared panel emitter and to a method of producing the same.

BACKGROUND OF THE INVENTION

Infrared radiation is that portion of the electromagnetic spectrum between visible light (0.72 microns ($\mu$)) and microwave (1000$\mu$). The infrared region is subdivided into near infrared (0.72$\mu$–1.5$\mu$), middle infrared (1.5$\mu$–5.6$\mu$), and far infrared (5.6$\mu$–1000$\mu$).

When an object passes in close proximity to an infrared source, infrared energy penetrates the material of that object and is absorbed by its molecules. The natural frequency of the molecules is increased, generating heat within the material, and the object becomes warm. Every material, depending upon its color and atomic structure, absorbs certain wavelengths of infrared radiation more readily than other wavelengths. Middle infrared is more readily absorbed by a greater number of materials than is the shorter wavelength near infrared radiation.

One type of infrared source is the "focused" emitter. This type emits a specific wavelength of infrared energy—usually in the near infrared region—which is a wavelength easily reflected and not readily absorbed by many materials. To compensate for this lack of penetration the intensity of such emitters is increased and reflectors are used to focus the emission on the process area. Increased intensity causes increased power consumption, hotter emitter operation requiring cooling systems, shorter emitter life, and damage to temperature-sensitive product loads which are being heated. Further, the condensation of process vapors on the reflector and emitter surfaces may cause a loss of intensity. Focused infrared sources generally require a substantial energy input, convert only 20 to 59% of the input energy to infrared radiation, and have a life expectancy of approximately 300 hours.

A well-known focused emitter is the T-3 lamp which consists of a sealed tubular quartz envelope enclosing a helically-wound tungsten filament (resistive element) supported by small tantalum discs. The tube is filled with an inert gas such as a halogen or argon to reduce oxidative degeneration of the filament. Due to the different thermal expansion coefficients of the quartz and the metal lead wires adequate cooling must be maintained at the seals or lamp failure will result. The T-3 lamp, when at rated voltage, operates at a peak wavelength of 1.15$\mu$ with a corresponding filament temperature of 2246° C.

Another commonly used focused emitter is the Ni/Cr alloy quartz tube lamp which is similar to the T-3 lamp in construction except that the filament is contained in a non-evacuated quartz tube. This infrared source, when at rated voltage, operates at a peak wavelength of 2.11$\mu$ with a corresponding filament temperature of 1100° C.

Nonfocused infrared panel emitters are available which operate on the secondary emission principle. Panel emitters contain resistive elements which disperse their energy to surrounding materials which in turn radiate the infrared energy more uniformly over the entire process area and across a wider spectrum of colors and atomic structures.

The resistive element of such panel emitters is typically a coiled wire or crimped ribbon foil and is placed in continuous channels which extend back and forth across the area of the panel. The curved portions of the channels at each end of the panel area limit the proximity of the wire or foil in adjacent channels. As a result, this construction limits the coverage of the panel area by the resistive element to 65 to 70% and this limited coverage makes it difficult to obtain precise temperature uniformity across the panel emitting surface.

Another known panel emitter comprises a glass emitting layer coated with tin oxide which serves as the resistive element. The tin oxide layer is applied by an expensive vapor deposition process.

SUMMARY OF THE INVENTION

It is one object of this invention to provide an improved infrared panel emitter having a minimum temperature variation across the emitting surface, and a method for making the same.

Another object of the invention is to provide an improved panel emitter that can be manufactured easily and economically.

Still another object is to provide such a panel emitter having a low power consumption.

In one aspect, the invention is a nonfocused infrared panel emitter consisting of a foil primary emitter positioned between an insulating layer and a secondary emitter. The etched electrode pattern of the foil covers from about 60 to about 90% of the total foil area, and preferably from about 80 to about 90%. The temperature variation across the panel emitting surface is less than about 0.5° C.

In another aspect, the invention is a bonded panel emitter consisting of a primary emitter, a secondary emitter, and an insulating layer bonded together by means of a binder, the binder, secondary emitter, and insulating layer all having small coefficients of thermal expansion which are substantially identical, preferably about 0.1% shrinkage at 1000° C. A void adjacent the primary emitter permits thermal expansion and contraction of the primary emitter.

In another aspect, the invention is a method of producing the panel emitter of the invention. A primary emitter is attached to a mesh sheet to form a composite which is positioned adjacent an insulating layer. A slurry of a binder is applied to the composite and allowed to penetrate through to the insulating layer. The secondary emitter is then placed adjacent the composite to form an assembly. Additional slurry is applied to the emitting surface of the secondary emitter. The assembly is then heated at a low temperature (preferably below 250° C.) to dry the moisture out of the panel components. The assembly is heated to a temperature (preferably below 500° C.) to vaporize the mesh sheet and form the void for thermal expansion of the foil. The assembly is then heated to a higher temperature (preferably above 800° C.) to bond together the secondary emitter, the primary emitter, and the insulating layer. The bonded panel emits infrared wavelength radiation in the middle and far infrared regions.

Other objects and advantages of the invention will be more fully understood from the accompanying drawings and the following description of several illustrative embodiments and the following claims. It should be understood that terms such as "upper," "lower," "above," and "below" used herein are for convenience of description only, and are not used in any limiting sense.

DETAILED DESCRIPTION OF THE PREFERRED EMBODIMENTS

Figure 1:
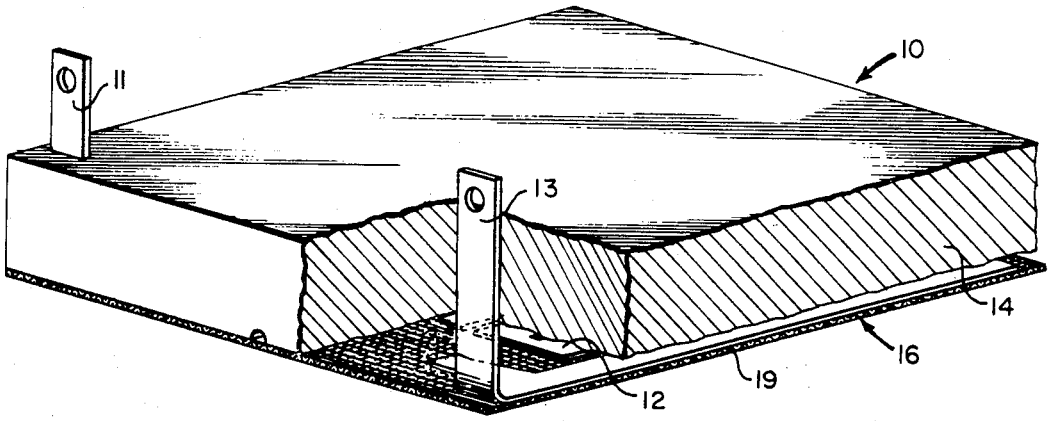
FIG. 1 is a perspective and partial sectional view of the panel emitter of the invention.

FIG. 1 shows one preferred embodiment of the panel emitter 10 of this invention. Panel emitter 10 may be of any desired shape and is shown for illustrative purposes only as being rectangular. Panel emitter 10 includes a primary emitter 12 disposed below an insulating layer 14 and a secondary emitter 16 disposed below the primary emitter. The lower surface of the secondary emitter is the panel emitting surface 19.

The insulating layer 14 is electrically insulating and reflects infrared radiation to ensure efficient emission by the panel in one direction only, i.e., down in FIG. 1. An insulating layer of from about 0.5 to about 3 inches in thickness can be used. For high temperature use the insulating layer should be made of alumina and silica and may be in blanket or board form. A preferred insulating layer is the 1.50 inch thick "hot board" made of alumina and silica, manufactured by the Carborundum Co., Niagara Falls, N.Y.

The primary emitter 12 is a resistive element and its resistance to the current passing through it causes it to heat and emit primary infrared radiation. The "primary" infrared radiation emitted by the primary emitter is absorbed by the secondary emitter 16, which causes the secondary emitter to be heated and emit "secondary" infrared radiation.

In a preferred embodiment the primary emitter 12 is a generally planar foil. The foil can be of any material having a high emmisivity factor, preferably greater than about 0.8, such as stainless steel. The foil should have a thickness of from about 0.0005 to about 0.005 inches. A preferred material is "Inconel" steel, made by United States Steel Corp., Pittsburg, Pa., having an emmisivity factor of 0.9 and a thickness of 0.003 inches. Two terminals 11 and 13 having a thickness greater than the foil extend from the foil for connection to a current source. The terminals may extend through openings 15 and 17 in the insulating layer in (see FIGS. 1, 3, and 4).

The foil is preferably spaced from about 0.125 to about 0.5 inches from all edges of the panel so the foil is not exposed and will not short circuit. For example, in a 12×18 inch panel, the foil has an 11.5×17.5 inch dimension and thus a 0.5 inch margin at each edge. This margin is small enough so that the secondary emitter at the margins can absorb and emit sufficient radiation to keep the entire 18×12 inch emitting surface at a uniform temperature.

Figure 2:
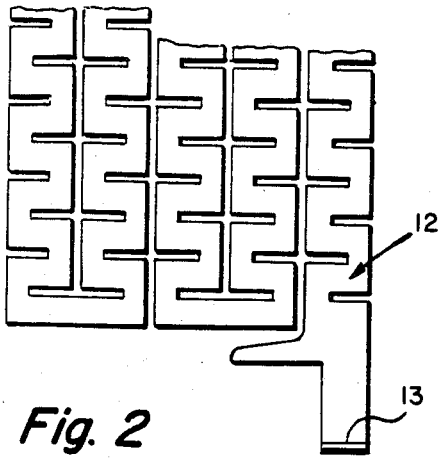
FIG. 2 is a partial plan view of the etched foil.

The foil has a pattern which is created by etching, and the pattern may be prepared by a known metal etching process. The pattern may cover of from about 60 to about 90% of the total foil area depending upon the wattage at which the panel will operate. Preferably the pattern is very closely spaced as shown in FIG. 2 so as to cover at least about 80 to about 90% of the total area. The use of a foil permits the formation of a precise and closely spaced primary emitter configuration and permits greater panel area coverage than prior art emitters having metal strips which are bent or folded at each end of the panel.

In a preferred embodiment of the invention, the primary emitter lies adjacent a very small void to permit thermal expansion and contraction of the primary emitter. This void is further described hereinafter in the method of making the panel emitter.

The secondary emitter 16 consists of an electrically insulating, high emissivity material having an emitting surface 19 for emitting secondary infrared radiation. Preferably the secondary emitter 16 is a thin (of from about 0.032 to about 0.040 inches) sheet, having a low mass, and an emmisivity factor of greater than about 0.8. A woven alumina cloth made by 3M Co., St. Paul, Minn., consisting of 98% alumina and 2% organic material, approximately 0.039 inches thick, and having an emissivity factor of 0.9, is preferred. An alumina paper made by The Carborundum Co., Niagra Falls, N.Y., and having approximately the same composition and thickness is another suitable example. Other materials which may be used to make the insulating layer and secondary emitter include silicon rubber and fiberglass.

Preferably, an electrically-insulating binder having a high emissivity factor, preferably of greater than about 0.8, is applied in slurry form to the panel components to aid in bonding together the secondary emitter, the primary emitter, and the insulating layer, as described hereinafter. The binder may be alumina and silica and should contain at least 20% silica by total weight of the slurry. A preferred material is "QF180" sold by The Carborundum Co., Niagara Falls, N.Y., which in slurry form consists of 65% alumina, 25% silica and 10% water by total weight of the slurry. It is important that the coefficients of thermal expansion of the binder, the secondary emitter, and the insulating layer be nearly identical to prevent warping of the panel during bonding.

Figure 3:
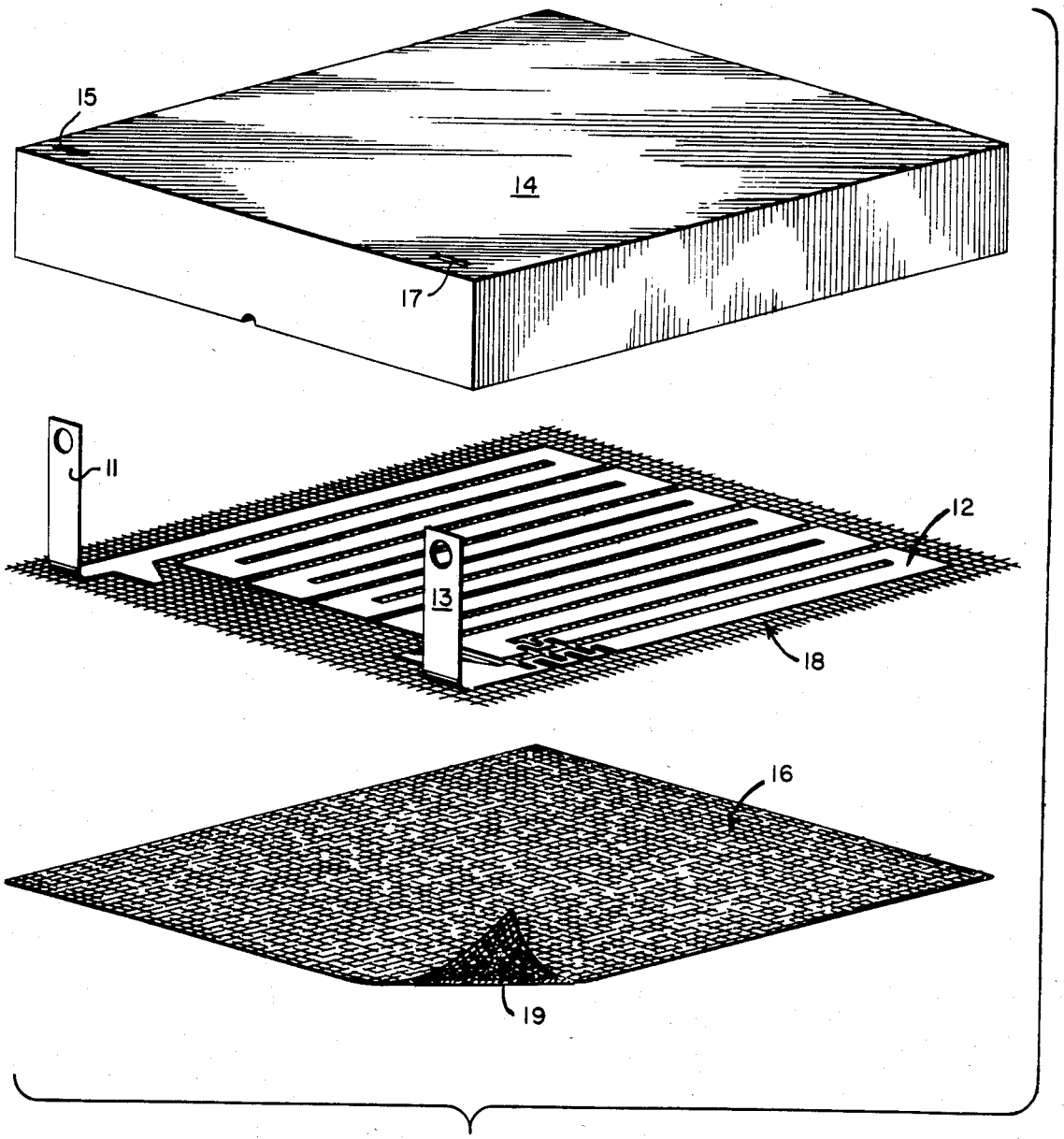
FIG. 3 is an exploded perspective view of the components used in the method of the invention.

With reference to FIG. 3, the method of making one embodiment of the panel emitter 10 of the invention will now be described, (like numbers refer to like parts, where appropriate). Primary emitter 12, is placed adjacent one surface of a mesh sheet 18 to form a composite. Insulating layer 14 is placed adjacent one surface of the composite and the terminals 11 and 13 are inserted through the openings 15 and 17 in the insulating layer. Preferably, a coating of the binder slurry is applied, for example, by brushing, to the top of the composite and allowed to penetrate through the openings in the mesh sheet and through the openings in the primary emitter and into the insulating layer. The excess slurry is then squeegeed off. The binder, the secondary emitter, and the insulating layer have nearly identical coefficients of thermal expansion.

Secondary emitter 16 is placed adjacent the surface of the composite opposing the insulating layer to form an assembly. A coating of the binder slurry is applied to the emitting surface 19 of the secondary emitter and allowed to penetrate through the insulating layer. The excess slurry is squeegeed off. While two applications of the slurry is preferred, i.e., one to the composite and one to the assembly, it is sufficient to use only one application to the assembly so long as the slurry penetrates through to the insulating layer.

Mesh sheet 18 may be positioned either between the insulating layer 14 and the primary emitter 16 or between the primary emitter 12 and the secondary emitter 16. Typically, the primary emitter 12 is first attached to the mesh sheet 18 for example, by gluing, and the mesh sheet is positioned adjacent the secondary emitter.

The assembly is then heated slowly to a temperature and for a period of time to dry the moisture (from the slurry) out of the components, especially the insulating layer 14. For example, the assembly may be heated to a temperature of not more than about 150° C. for 60 minutes.

The assembly is then heated to a temperature and for a period of time to vaporize the mesh sheet 18, for reasons described hereinafter, and to vaporize the excess binder. For example, the assembly may be heated to a temperature below about 500° C. for 60 minutes.

The assembly is then heated to a temperature and for a period of time to bond together the secondary emitter 16, the primary emitter 12, and the insulating layer 14. By heating above about 800° C. and preferably at about 1000° C. for at least 60 minutes the silica in the binder vitrifies and bonds together the panel components to form a vitreous panel emitter. Further, depending upon how high a temperature is used, voids are eliminated within and between the insulating layer and the secondary emitter to form a sintered body.

The mesh sheet 18 may be formed of any material which vaporizes at a temperature less than the temperature at which the components of the panel are bonded together. The purpose of the mesh is to support the primary emitter 12 during processing and to create a small void between the secondary emitter 16 and insulating layer 14 to allow unrestricted thermal expansion and contraction by the primary emitter 12 in the bonded panel emitter. The mesh sheet 18 may be placed either between the primary emitter 12 and the secondary emitter 16 or between the insulating layer 14 and the primary emitter 12, preferably the former. The openings in the mesh allow the binder to penetrate through to the insulating layer 14 to aid in bonding. The mesh preferably has a thickness of from about 0.010 to about 0.030 inches, has openings of at least about 0.125 inches, and vaporizes at a temperature below about 350° C. A preferred material is a loosely woven nylon mesh approximately 0.015 mil thick which decomposes at approximately 350° C.

A preferred embodiment of the panel emitter made according to the method of invention is shown in cross-section in FIG. 1. The secondary emitter 16 consists of a woven alumina cloth. An etched foil 12 lies adjacent the alumina cloth 16 and can expand and contract within the void (not shown) left by the mesh sheet between the insulating layer 14 and the alumina cloth 16. An alumina silica binder (not shown) bonds together the cloth, foil, and insulating layer.

The alumina cloth, alumina silica slurry, and alumina silica insulating layer are preferred, especially for use at high temperatures. The alumina content of the insulating layer and secondary emitter should be greater than about 70% by weight; the binder slurry should contain from about 20 to about 50% silica by total weight of the slurry to achieve a vitreous bond. The coefficients of thermal expansion of the alumina cloth, alumina silica binder, and the alumina silica insulating layer are small and substantially identical—namely, all about 0.1% shrinkage at 1000° C. Materials which shrink more than about 1% should not be used in the panel as it will warp during bonding.

Figure 4:
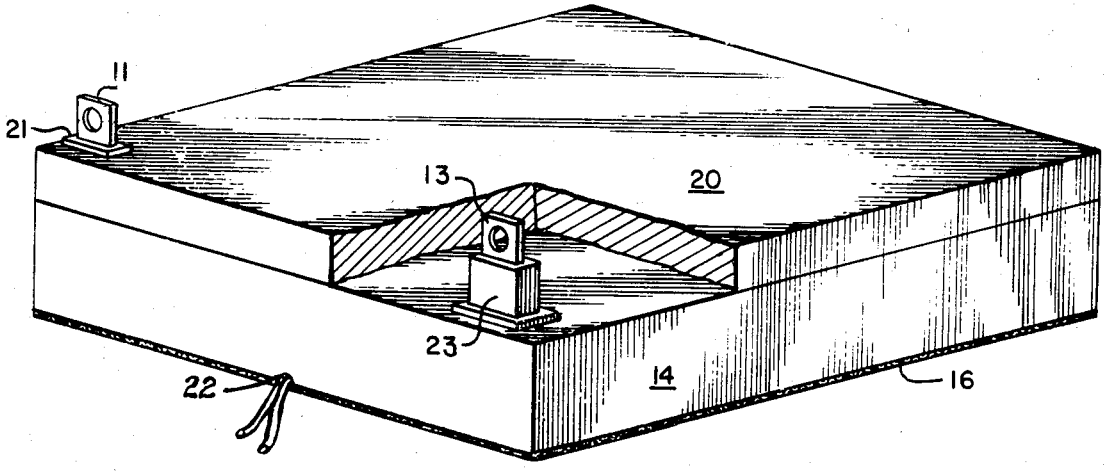
FIG. 4 is a perspective and partial sectional view of the panel emitter in a housing and connected to a thermocouple.

As shown in FIG. 4, to provide additional support the bonded panel may be disposed in a steel housing 20 by connecting the insulating layer 14 to the housing 20 with ceramic lugs 21 and 23. Further, a vicor glass plate (not shown), which is translucent to infrared radiation, may be applied over the emitting surface 19 to protect it from wear. A quartz tube containing a thermocouple 22 may be positioned in a channel in the insulating layer 14 and adjacent the primary emitter 12 for monitoring the temperature of the primary emitter 12.

The panel emitter of the invention radiates infrared energy evenly and uniformly across its entire emitting surface 19. The temperature variation across the panel can be limited to 0.5° C. or less. The panel emits a broad band of radiation in the middle and far regions and thus readily penetrates and is absorbed by materials having a wide range of colors and atomic structures. Within that broad band the panel emits a peak wavelength which can be adjusted within the broad range by varying the temperature of the primary emitter for selective heating of selected materials and colors within a product load. The panel emitters can be used for solder attachment of surface mounted devices to printed circuit boards. One type of panel emitter has been designed for this use having a peak temperature rating of 800° C. which corresponds to a peak wavelength of 2.7$\mu$.

A 12 inch square panel emitter of the invention converts 80 to 90% of all input energy to process energy. Typically, this panel draws only about 4.5 amps at start up and drops to 2.2 amps after warm-up. This panel is unaffected by occasional voltage variations often encountered in production environments. The life expectancy of the panels is typically 6,000 to 8,000 hours plus.

Although the invention has been described above by reference to several preferred embodiments, many additional modifications and variations thereof will now be apparent to those skilled in the art. Accordingly, the scope of the invention is to be limited not by the details of the illustrative embodiments described herein, but only by the terms of the appended claims and their equivalents.

I claim:

1. An infrared panel emitter comprising:

an insulating layer;

a secondary emitter comprising an electrically insulating, high emissivity material;

a metal foil having an etched pattern for emitting primary infrared radiation positioned between said insulating layer and said secondary emitter, said metal foil being formed independently of both said secondary emitter and said insulating layer and not being secured directly thereto to permit said metal foil to expand and contract freely with respect to said insulating layer and said secondary emitter;

the primary radiation being reflected by said insulating layer and absorbed by said secondary emitter and said secondary emitter emitting secondary infrared radiation from a secondary emitting surface thereof;

a void adjacent one entire lateral surface of said metal foil to permit thermal expansion and contraction of said metal foil; and means for securing together said insulating layer and said secondary emitter to capture said metal foil therebetween.

2. The panel emitter of claim 1 wherein said securing means comprises an electrically-insulating, high emissivity binder disposed between said insulating layer and said secondary emitter, said binder, said insulating layer, and said secondary emitter having substantially identical coefficients of thermal expansion, and wherein said coefficients of thermal expansion of said binder, said insulating layer, and said secondary emitter are below about 1% to 1000° C.

3. The panel emitter of claim 2 wherein said coefficients of thermal expansion of said binder, said insulating layer, and said secondary emitter are about 0.1% at 1000° C.

4. The panel emitter of claim 1 wherein said metal foil has an etched pattern.

5. The panel emitter of claim 4 wherein said metal foil has an electrode pattern covering of from about 80 to about 90% of the total foil area.

6. The panel emitter of claim 2 wherein said secondary emitter is a woven alumina cloth.

7. The panel emitter of claim 6 wherein said insulating layer is an alumina silica board.

8. The panel emitter of claim 7 wherein said binder comprises alumina and silica.

9. The panel emitter of claim 1 wherein said void has a thickness of from about 0.010 to about 0.030 inches.

10. The panel emitter of claim 1 wherein the temperature variation across said secondary emitting surface is less than about 0.5° C.

11. The panel emitter of claim 1 wherein said secondary infrared radiation is in the middle and far infrared regions.

12. The panel emitter of claim 11 wherein said secondary infrared radiation has a peak wavelength of approximately 2.7$\mu$.

13. A method for producing an infrared panel emitter comprising:

forming a composite of a mesh sheet having openings and means for emitting primary infrared radiation having openings;

placing an insulating layer for reflecting said primary radiation adjacent one surface of said composite;

locating an electrically-insulating, high emissivity material adjacent the opposite surface of said composite to form an assembly, said material having a secondary infrared emitting surface on the side opposite of said composite;

securing together said insulating layer and said high emissivity material to capture said composite therebetween; and heating said assembly to vaporize said mesh sheet.

14. The method fo claim 13 wherein said securing step comprises the step of applying a slurry comprising water and an electrically insulating, high emissivity binder to said secondary emitting surface and allowing said slurry to penetrate through said openings in said mesh sheet and said primary emitting means to said insulating layer, said binder, said material, and said insulating layer having substantially identical coefficients of thermal expansion, and wherein said heating step comprises the steps of:

heating said assembly to a first temperature for a first predetermined period of time for evaporating said water from said slurry in said assembly;

heating said assembly to a second temperature higher than said first temperature for a second predetermined period of time for vaporizing said mesh sheet to form a void adjacent said primary emitting means to permit thermal expansion and contraction of said primary emitting means; and heating said assembly to a third temperature higher than said second temperature for a third predetermined period of time to bond together said insulating layer, said emitting means, and said material.

15. The method of claim 13 wherein said primary emitting means is a metal foil.

16. The method of claim 15 wherein said metal foil has an etched electrode pattern covering of from about 80 to about 90% of the total foil area.

17. The method of claim 14 wherein said material is a woven alumina cloth.

18. The method of claim 17 wherein said insulating layer is an alumina silica board.

19. The method of claim 18 wherein said binder comprises alumina and silica.

20. The method of claim 14 wherein said first temperature is below about 150° C.

21. The method of claim 14 wherein said second temperature is below about 500° C.

22. The method of claim 14 wherein said third temperature is above about 800° C.

23. The method of claim 13 wherein said primary emitting means is first bonded to one surface said mesh sheet.

24. The method of claim 14 further comprising prior to said locating step the step of:

applying said slurry to said composite to penetrate through to said insulating layer.

* * * * *